US007825865B2

(12) United States Patent
Ibe et al.

(10) Patent No.: US 7,825,865 B2
(45) Date of Patent: Nov. 2, 2010

(54) GLASS ANTENNA FOR AN AUTOMOBILE

(75) Inventors: Masaki Ibe, Chiyoda-ku (JP); Kenichiro Shimo, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 394 days.

(21) Appl. No.: 11/957,802

(22) Filed: Dec. 17, 2007

(65) Prior Publication Data

US 2008/0158073 A1 Jul. 3, 2008

(30) Foreign Application Priority Data

Dec. 27, 2006 (JP) ..... 2006-352019

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS

| | | | | |
|---|---|---|---|---|
| 4,803,492 | A * | 2/1989 | Inaba et al. | 343/713 |
| 5,334,989 | A * | 8/1994 | Nagayama et al. | 343/713 |
| 5,499,034 | A * | 3/1996 | Fujii et al. | 343/713 |
| 6,229,493 | B1 * | 5/2001 | Iijima | 343/713 |
| 7,019,700 | B2 * | 3/2006 | Fujii et al. | 343/713 |
| 7,456,796 | B2 * | 11/2008 | Nagayama et al. | 343/713 |
| 2008/0158073 | A1 * | 7/2008 | Ibe et al. | 343/713 |

FOREIGN PATENT DOCUMENTS

| | | |
|---|---|---|
| EP | 0 856 904 A2 | 8/1998 |
| EP | 0 963 002 A1 | 12/1999 |
| JP | 58-70644 | 4/1983 |
| JP | 58-70646 | 4/1983 |
| JP | 61-265904 | 11/1986 |
| JP | 9-181514 | 7/1997 |
| JP | 9-284025 | 10/1997 |
| JP | 10-13126 | 1/1998 |
| JP | 10-51219 | 2/1998 |
| JP | 10-145122 | 5/1998 |
| JP | 10-341104 | 12/1998 |
| JP | 2001-168622 | 6/2001 |

* cited by examiner

*Primary Examiner*—Huedung Mancuso
(74) *Attorney, Agent, or Firm*—Oblon, Spivak, McClelland, Maier & Neustadt, L.L.P.

(57) ABSTRACT

A defogger is disposed in or on a rear window glass sheet. The rear window glass sheet has an H-oriented antenna conductor for frequency band H higher than frequency band L, an L-oriented antenna conductor for frequency band L, and a feeding point disposed in a blank space thereof above the defogger therein or thereon, the feeding point being connected to the H-oriented antenna conductor and the L-oriented antenna conductor, the H-oriented antenna conductor comprising H-oriented antenna elements, the L-oriented antenna conductor comprising L-oriented antenna elements and a directivity-adjusting antenna element, the directivity-adjusting antenna element being connected to the L-oriented antenna elements, a first H-oriented antenna element and a first L-oriented antenna element being capacitively coupled, and a second H-oriented antenna element and a second L-oriented antenna element being capacitively coupled.

24 Claims, 6 Drawing Sheets

GLASS ANTENNA FOR AN AUTOMOBILE

The present invention relates to a glass antenna for an automobile, which is appropriate to receive an AM broadcast and an FM broadcast.

There has been used a glass antenna for an automobile, which is disposed in or on a rear window glass sheet 12 with an electric heating defogger, the defogger comprising a plurality of heater strips 14, and a plurality of bus bars 15*a* and 15*b* configured to feed a current to the heater strips 14 as shown in FIG. 3, and which has an antenna conductor 42 for an AM broadcast band, a feeding point 45*b* for the AM broadcast band, an antenna conductor 41 for an FM broadcast band, and a feeding point 45*a* for the FM broadcast band disposed in a blank space of the rear window glass sheet 12 above the defogger in or on the rear window glass sheet.

However, this conventional antenna has an insufficient antenna gain. In FIG. 3, reference numeral 30 designates a DC power supply, reference numeral 31 designates a switch, reference numerals 16 and 17 designate short-circuit lines, which are disposed as needed, reference numeral 13 designates a vehicle opening edge for the window, and reference numeral 46 designates the centerline of the rear window glass sheet 12 in a left-to-right direction of the rear window glass sheet. Although the number of the heater strips 14 shown in FIG. 3 is 11, the actual number is 17. This antenna has problems of a low antenna gain and of a poor flatness in terms of the antenna gain for an FM broadcast band.

It is an object of the present invention to provide a glass antenna for an automobile, which is capable of solving the above-mentioned problems involved in the conventional antenna.

The present invention provides a glass antenna for an automobile, which is disposed in or on a rear window glass sheet with an electric heating defogger, the defogger comprising a plurality of heater strips and a plurality of bus bars configured to feed a current to the heater strips, and which has an H-oriented antenna conductor for frequency band H higher than frequency band L, an L-oriented antenna conductor for frequency band L, and a feeding point disposed in a blank space of the rear window glass sheet above the defogger in or on the rear window glass sheet, the feeding point being connected to the H-oriented antenna conductor and the L-oriented antenna conductor; comprising:

the H-oriented antenna conductor comprising a first H-oriented antenna element and a second H-oriented antenna element;

the L-oriented antenna conductor comprising a first L-oriented antenna element, a second L-oriented antenna element and a directivity-adjusting antenna element;

both of the first H-oriented antenna element and the second H-oriented antenna element being configured to extend in a direction to be away from a side of the feeding point;

the first L-oriented antenna element and the second L-oriented antenna element being connected to the directivity-adjusting antenna element, and both of the first L-oriented antenna element and the second L-oriented antenna element being configured to extend from a side of the directivity-adjusting antenna element toward the side of the feeding point;

the first H-oriented antenna element and the first L-oriented antenna element being adjacent to each other and capacitively coupled, forming a first capacitively-coupled portion; and the second H-oriented antenna element and the second L-oriented antenna element being adjacent to each other and capacitively coupled, forming a second capacitively-coupled portion.

The present invention also provides a glass antenna for an automobile, which is disposed in or on a rear window glass sheet with an electric heating defogger, the defogger comprising a plurality of heater strips and a plurality of bus bars configured to feed a current to the heater strips, and which has an H-oriented antenna conductor for frequency band H higher than frequency band L, an H-oriented feeding point, an L-oriented antenna conductor for frequency band L, and an L-oriented feeding point disposed in a blank space of the rear window glass sheet above the defogger in or on the rear window glass sheet, the H-oriented feeding point being connected to the H-oriented antenna conductor, and the L-oriented feeding point being connected to the L-oriented antenna conductor; comprising:

the H-oriented feeding point and the L-oriented feeding point having a shortest distance of 0.1 to 200 mm therebetween;

the H-oriented antenna conductor comprising a first H-oriented antenna element and a second H-oriented antenna element;

the L-oriented antenna conductor comprising a first L-oriented antenna element, a second L-oriented antenna element and a directivity-adjusting antenna element;

both of the first H-oriented antenna element and the second H-oriented antenna element being configured to extend in a direction to be away from a side of the H-oriented feeding point;

the first L-oriented antenna element and the second L-oriented antenna element being connected to the directivity-adjusting antenna element, and both of the first L-oriented antenna element and the second L-oriented antenna element being configured to extend from a side of the directivity-adjusting antenna element toward a side of the L-oriented feeding point;

the first H-oriented antenna element and the first L-oriented antenna element being adjacent to each other and capacitively coupled, forming a first capacitively-coupled portion; and the second H-oriented antenna element and the second L-oriented antenna element being adjacent to each other and capacitively coupled, forming a second capacitively-coupled portion.

The present invention can improve the antenna gain for frequency band H and is excellent in non-directivity for frequency band H because of adopting any one of the above-mentioned structures. The present invention is also excellent in flatness in terms of the antenna gain for frequency band H. The present invention can also improve the antenna gain for frequency band L.

Further, the present invention can effectively utilize the blank space above the defogger, which is a limited space. In other words, even if the blank space above the defogger has such an extremely narrow area that the distance between the uppermost portion of the defogger (such as, the heating strip at the highest position) and an upper side of a vehicle opening edge is about 120 to 200 mm, the present invention can provide a glass antenna for an automobile, which has an excellent antenna performance.

When the feeding point, the H-oriented feeding point and the L-oriented feeding point are disposed in a left-hand area in the vicinity of the vehicle opening edge in a blank space of the rear window glass sheet above a left portion of the defogger as seen from a car-interior-side or a car-exterior-side, it is extremely convenient to perform a mounting operation for connecting a cable to the feeding point, or the H-oriented feeding point and the L-oriented feeding point. Furthermore, the present invention can ensure good sight in a blank space of the rear window glass sheet above a right-hand portion of the defogger.

Figure 1:
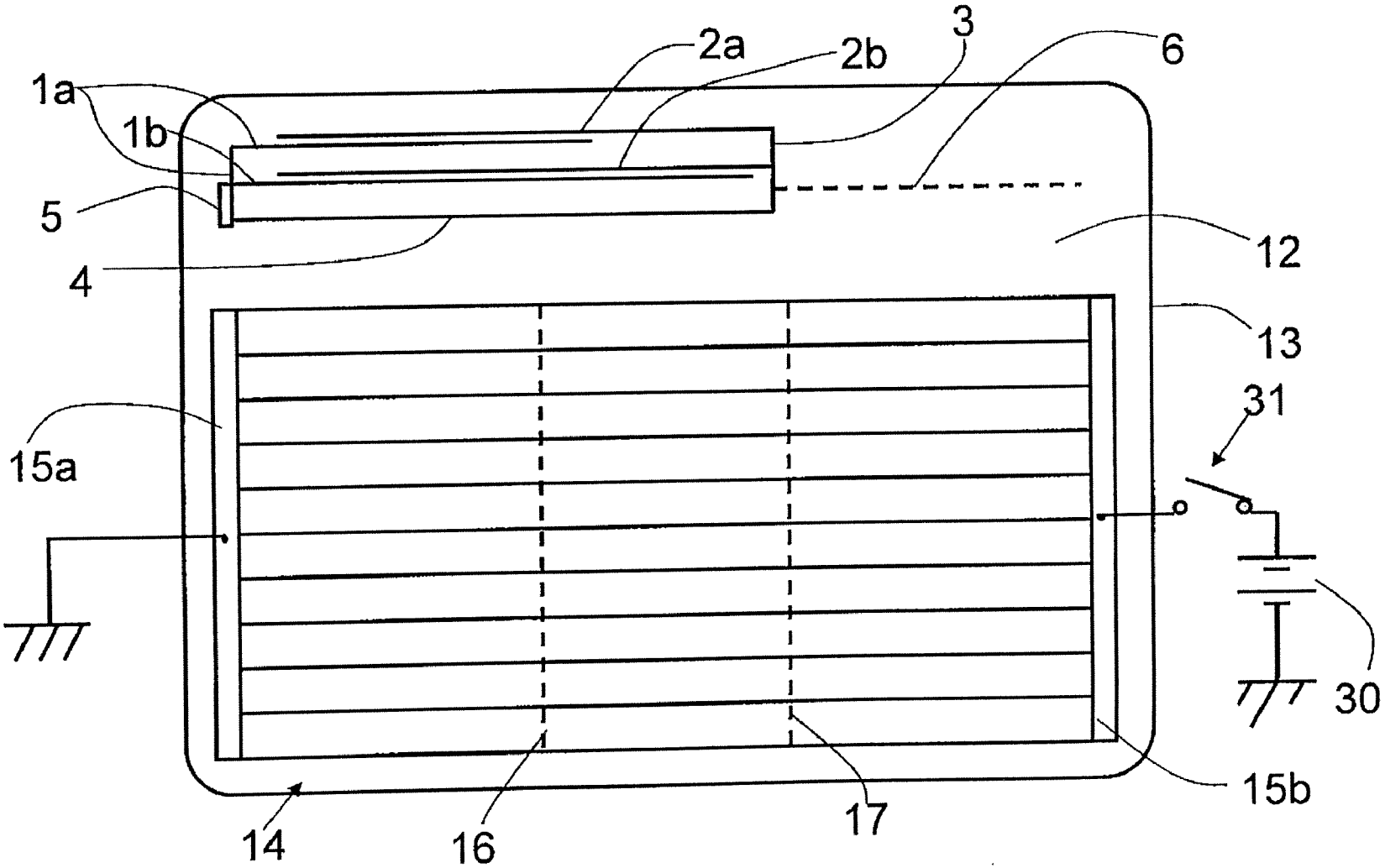
FIG. 1 is a schematic view showing an embodiment of a first mode of the present invention.

The present invention has the purpose of receiving, in a good condition, a signal in frequency band L and frequency band H higher than frequency band L. An example of frequency band L is an AM broadcast band. An example of frequency band H is an FM broadcast band.

The present invention has two modes of a first mode and a second mode. The first mode includes a single feeding point, which commonly feeds a signal for both of frequency band L and frequency band H. The second mode includes two feeding points, which feed a signal for frequency band L and frequency band H, respectively. In the following explanation, antenna elements will be called elements for simplification. For example, a first antenna element for frequency band H is called a first H-oriented element.

First, the first mode will be described. In the first mode, an electric heating defogger, which comprises a plurality of heater strips and a plurality of bus bars configured to feed a current to the heater strips, is disposed in or on a rear window glass sheet. In a blank space of the rear window glass sheet above the defogger, there are disposed an H-oriented antenna conductor for frequency band H higher than frequency band L, an L-oriented antenna conductor for frequency band L, and a feeding point. The feeding point is connected to both of the H-oriented antenna conductor and the L-oriented antenna conductor.

The H-oriented antenna conductor comprises a first H-oriented element and a second H-oriented element. The L-oriented antenna conductor comprises a first L-oriented element, a second L-oriented element and a directivity-adjusting element. The directivity-adjusting element affects the directivity in frequency band H by changing its position. This function is also applicable to the second mode, which will be described later.

Both of the first H-oriented element and the second H-oriented element are configured to extend toward a direction to be away from the side of the feeding point. The first L-oriented element and the second L-oriented element are connected to the directivity-adjusting element. Both of the first L-oriented element and the second L-oriented element are configured to extend from the side of the directivity-adjusting element toward the side of feeding point.

The first H-oriented element and the first L-oriented element are adjacent to each other and capacitively coupled together. The second H-oriented element and the second L-oriented element are adjacent to each other and capacitively coupled together. The reason why the two capacitively-coupled portions are disposed as stated above is that the antenna gain can be significantly improved when receiving a signal in frequency band H in comparison with a case where only a single capacitively-coupled portion is disposed. This function is also applicable to the second mode, which will be described later.

Now, the second mode will be described. In the second mode, an electric heating defogger, which comprises a plurality of heater strips and a plurality of bus bars configured to feed a current to the heater strips, is disposed in or on a rear window glass sheet. In a blank space of the rear window glass sheet above the defogger, there are disposed an H-oriented antenna conductor for frequency band H higher than frequency band L, an H-oriented feeding point, an L-oriented antenna conductor for frequency band L, and an L-oriented feeding point. The H-oriented feeding point is connected to the H-oriented antenna conductor. The L-oriented feeding point is connected to the L-oriented antenna conductor.

The H-oriented antenna conductor comprises a first H-oriented element and a second H-oriented element, and the L-oriented antenna conductor comprises a first L-oriented element, a second L-oriented element and a directivity-adjusting element.

Both of the first H-oriented element and the second H-oriented element are configured to extend toward a direction to be away from the side of the H-oriented feeding point. The first L-oriented element and the second L-oriented element are connected to the directivity-adjusting element. Both of the first L-oriented element and the second L-oriented element are configured to extend from the side of the directivity-adjusting element toward the side of the L-oriented feeding point. The first H-oriented element and the first L-oriented element are adjacent to each other and capacitively coupled together. The second H-oriented element and the second L-oriented element are adjacent to each other and capacitively coupled together.

The features common to the first mode and the second mode will be described.

Each of the first H-oriented element, the second H-oriented element, the first L-oriented element and the second L-oriented element has a leading portion or an open end. The leading portion means the portion of each of the elements farthest from the side of the feeding point (the side of the H-oriented feeding point and the L-oriented feeding point in the second mode). The leading portion may have a looped portion formed in the vicinity thereof.

When a portion where the first H-oriented element and the first L-oriented element are adjacent to each other and capacitively coupled together is called a first capacitively-coupled portion, it is preferred that the leading portion or the open end of the first H-oriented element be disposed in the first capacitively-coupled portion. It is also preferred that the leading portion or the open end of the first L-oriented element be disposed in the first capacitively-coupled portion.

When a portion where the second H-oriented element and the second L-oriented element are adjacent to each other and capacitively coupled together is called a second capacitively-coupled portion, it is preferred that the leading portion or the open end of the second H-oriented element be disposed in the second capacitively-coupled portion. It is also preferred that the leading portion or the open end of the second L-oriented element be disposed in the second capacitively-coupled portion.

In a case where the first capacitively-coupled portion is disposed at a position closer to a vehicle opening edge for the window than the second capacitively-coupled portion, when the portion of the vehicle opening edge for the window closet to the first capacitively-coupled portion is called a closest vehicle opening edge portion, it is preferred that the first L-oriented element be disposed at a position closer to the closest vehicle opening edge portion than the first H-oriented element in the first capacitively-coupled portion. When this arrangement is adopted, the antenna gain can be significantly improved when receiving a signal in frequency band H in comparison with a case where the first H-oriented element is disposed at a position closer to the closest vehicle opening edge portion than the first L-oriented element. It is preferred that the second L-oriented element be disposed at a position closer to the closest vehicle opening edge portion than the second H-oriented element in the second capacitively-coupled portion. When this arrangement is adopted, the antenna gain can be significantly improved when receiving a signal in frequency band H in comparison with a case where the second H-oriented element is disposed at a position closer to the closest vehicle opening edge portion than the second L-oriented element. It should be noted that the vehicle opening edge means a peripheral edge of a vehicle opening to fit the window glass sheet thereinto, which serves as vehicle grounding and is made of a conductive material, such as metal.

When frequency band H contains a frequency selected from the Japanese FM broadcast band (76 to 90 MHz), the US FM broadcast band (88 to 108 MHz) and a lower band of a television VHF band (90 to 108 MHz), the average distance between the first H-oriented antenna element and the second L-oriented antenna element is preferably from 10.5 to 19.5 mm, particularly from 12 to 18 mm in order to obtain an improved directivity. When the average distance is 10.5 mm or longer, the antenna gain can be advantageously improved in comparison with a case where the average distance is shorter than 10.5 mm. When the average distance is 19.5 mm or shorter, the antenna can be advantageously closer to a non-directional antenna in comparison where the average distance is longer than 19.5 mm.

It is preferred that the directivity-adjusting element be connected to an H-oriented adjusting element disposed in or on the rear window glass sheet, and that the H-oriented adjusting element be disposed in a side opposite to the first capacitively-coupled portion with respect to the directivity-adjusting element. When this arrangement is adopted, the antenna gain for frequency band H can be improved in comparison with a case where the H-oriented adjusting element is disposed in the same side as the first capacitively-coupled portion with respect to the directivity-adjusting element.

Figure 4:
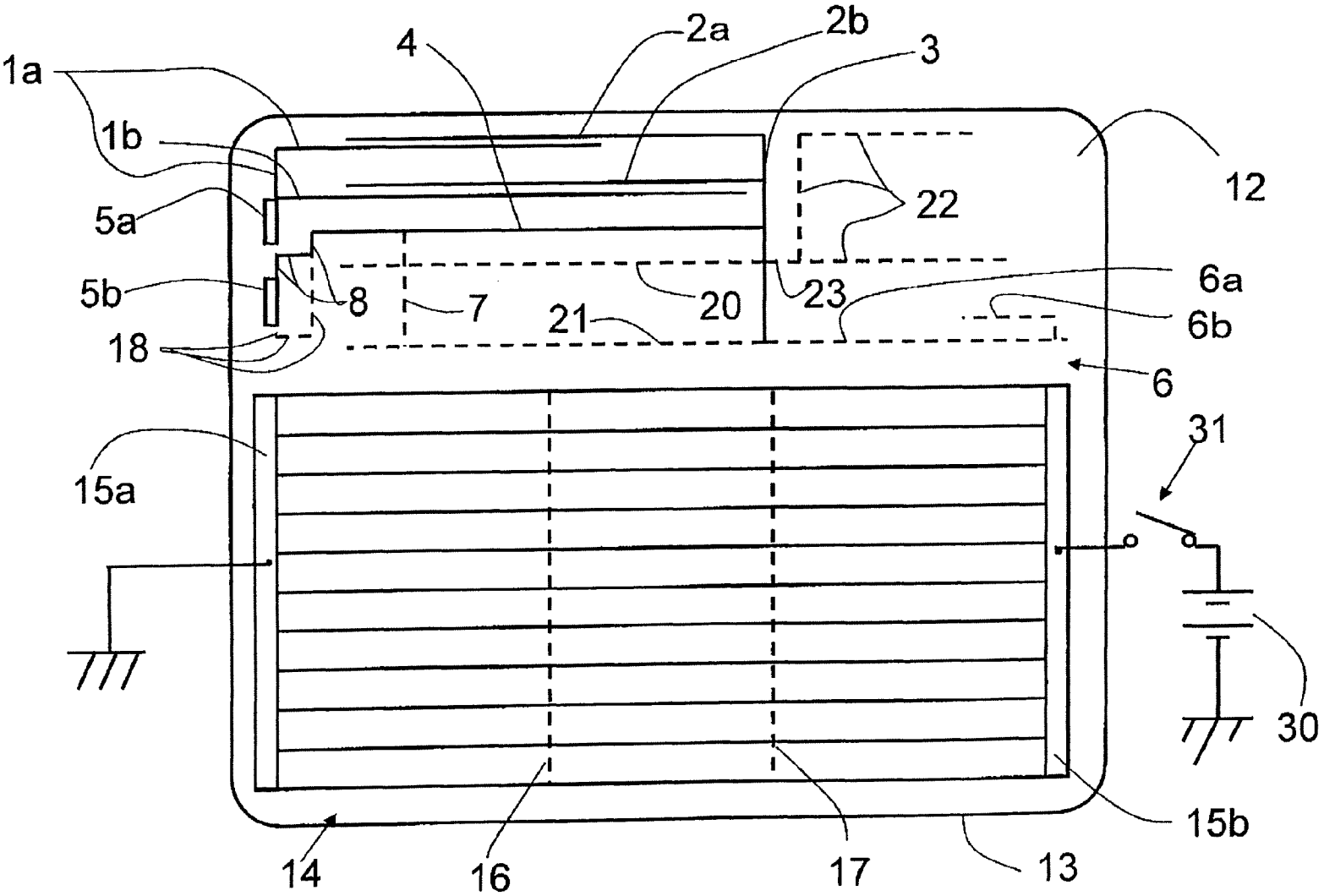
FIG. 4 is a schematic view showing another embodiment of the second mode of the present invention, which is different from the embodiment shown in FIG. 2.

As shown in FIG. 4 referred to later, the H-oriented adjusting element 6 (shown in a dotted line) is disposed as needed, and the H-oriented adjusting element is configured to extend preferably in a transverse direction or a substantially transverse direction, particularly in a horizontal direction or a substantially horizontal direction, starting at the directivity-adjusting element 3. It is preferred in terms of improving the antenna gain for frequency band H that the H-oriented adjusting element be configured to have a first portion extended, followed by having a second portion turned back and further extended along the first portion of the H-oriented adjusting element 6 toward a direction with the starting point located.

The first portion of the H-oriented adjusting element 6, which is extended in the horizontal direction or the substantially horizontal direction, broadly in the transverse direction or the substantially transverse direction, starting at the directivity-adjusting element 3, is called an H-oriented adjusting element base portion 6*a* (shown in a dotted line). The second portion of the H-oriented adjusting element, which is turned back and further extended along the first portion of the H-oriented adjusting element toward the direction with the starting point located, is called an H-oriented adjusting element return portion 6*b* (shown in a dotted line). It is preferred in terms of space saving that the H-oriented adjusting element base portion 6*a* and the H-oriented adjusting element return portion 6*b* be parallel or substantially parallel to each other. In a case where this arrangement is adopted, when frequency band H contains a frequency selected from the Japanese FM broadcast band, the US FM broadcast band and the lower band of the television VHF band, the distance between both portions is preferably from 5 to 15 mm, particularly from 8 to 12 mm in order to obtain an improved antenna gain for frequency band H.

In a case where the first L-oriented element includes an L-oriented transverse element, when the L-oriented transverse element is electrically connected to the feeding point in the first mode, or when the L-oriented transverse element is electrically connected to the L-oriented feeding point in the second mode, the L-oriented transverse element is configured to extend preferably in the transverse direction or the substantially transverse direction, particularly in the horizontal direction or the substantially horizontal direction from the side of the feeding point or the side of the L-oriented feeding point in order to obtain an improved antenna gain for frequency band H. When this arrangement is adopted, it is preferred in terms of obtaining an improved antenna gain for frequency band H that the L-oriented transverse element be connected to the directivity-adjusting element, and that the second capacitively-coupled portion partly or entirely be disposed between the first capacitively-coupled portion and the L-oriented transverse element.

It is assumed that the center frequency of frequency band H has a wavelength of $\lambda_0$ in the air, that glass has a shortening coefficient of wavelength of k, that the formula of k=0.64 is established, that the formula of $\lambda_g=\lambda_0 \cdot k$ is established, and that a region of the rear window glass sheet for the first capacitively-coupled portion has a conductive layer disposed therein. In the first mode under this assumption, it is preferred in terms of obtaining an improved antenna gain for frequency band H that the shortest route passing from the feeding point to a leading portion or an open end of the H-oriented adjusting element though the first H-oriented element, the conductive layer, the first L-oriented element and the directivity-adjusting element in that order, and excluding the feeding point, have a route length of 0.7 $\lambda$g to $\lambda$g.

In the second under this assumption, it is preferred in terms of obtaining an improved antenna gain for frequency band H that the shortest route passing from the H-oriented feeding point to a leading portion or an open end of the H-oriented adjusting element though the first H-oriented element, the conductive layer, the first L-oriented element and the directivity-adjusting element in that order, and excluding the H-oriented feeding point, have a route length of 0.7 $\lambda$g to $\lambda$g.

Now, the glass antenna for an automobile according to the present invention will be described in detail, based on preferred embodiments, which are shown in accompanying drawings. FIG. 1 is a schematic view (seen from a car-interior-side or a car-exterior side) showing an embodiment of the first mode of the present invention.

A rear window glass sheet 12 has a feeding point 5 disposed in a left-hand region of a blank space thereof as seen from the car-interior-side or the car-exterior-side, and the feeding point 5 is connected to a first H-oriented element 1*a* and a second H-oriented element 1*b*. The feeding point 5 is also connected to an L-oriented transverse element 4. In the embodiment shown in FIG. 1, the L-oriented transverse element 4 is electrically connected to the feeding point 5. However, the present invention is not limited to this arrangement. The L-oriented transverse element 4 may be connected to the feeding point 5 through a connecting conductor. In other words, it is sufficient that the L-oriented transverse element 4 is electrically connected to the feeding point 5.

Figure 2:
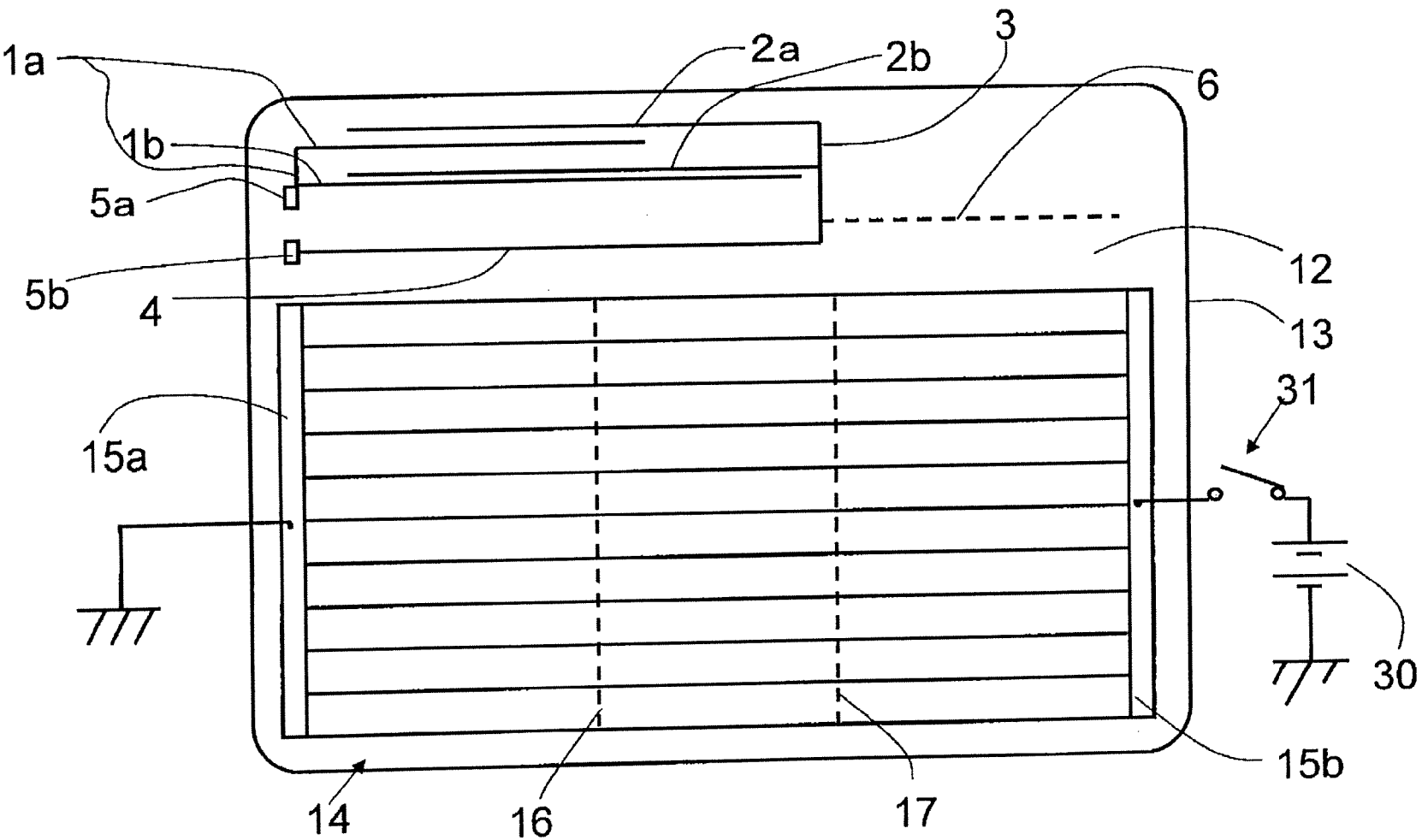
FIG. 2 is a schematic view showing an embodiment of a second mode of the present invention.

FIG. 2 is a schematic view showing an embodiment of the second mode of the present invention. The mode shown in FIG. 2 is substantially the same as the mode shown in FIG. 1 except that an H-oriented feeding point 5*a* is connected to a first H-oriented element 1*a* and a second H-oriented element 1*b* and that an L-oriented feeding point 5*b* is electrically connected to an L-oriented transverse element 4. The shortest distance between the H-oriented feeding point 5*a* and the L-oriented feeding point 5*b* is preferably from 0.1 to 200 mm. When the shortest distance is 0.1 mm or longer, it becomes advantageously easy to produce the antenna in comparison with a case where the shortest distance is shorter than 0.1 mm. The shortest distance is preferably 200 mm or shorter because of having more convenient mounting in comparison with a case where the shortest distance is longer than 200 mm. The shortest distance ranges preferably from 1 to 100 mm, more preferably from 2 to 50 mm.

In the embodiment shown in FIG. 2, the L-oriented transverse element 4 is directly connected to the L-oriented feeding point 5*b*. However, the present invention is not limited to this arrangement. The L-oriented transverse element 4 may be connected to the L-oriented feeding point 5*b* through a connecting conductor. In other words, it is sufficient that the L-oriented transverse element 4 is electrically connected to the L-oriented feeding point 5*b*.

As seen from the car-interior-side or the car-exterior-side, the L-oriented transverse element 4 is configured to extend from the side of the feeding point (the side of the H-oriented feeding point 5*a* and the L-oriented feeding point 5*b* in the second mode) toward a right-hand region of the blank space and in a horizontal direction or a substantially horizontal direction, broadly in a transverse direction or a substantially transverse direction. In the embodiment shown in FIG. 2, the L-oriented transverse element 4 has a directivity-adjusting element 3 connected to a leading portion thereof. However, the present invention is not limited to this arrangement. The invention is operable as long as the L-oriented transverse element 4 is connected to the directivity-adjusting element 3.

The directivity-adjusting element 3 is configured to extend in a vertical direction or a substantially vertical direction of the rear window glass sheet 12. However, the present invention is not limited to this arrangement. The present invention is operable as long as at least a main portion of the directivity-adjusting element 3 is configured to extend in the vertical direction or the substantially vertical direction of the rear window glass sheet 12. The main portion means a portion occupying 50% or more of the conductor length of the directivity-adjusting element 3.

It is preferred that the directivity-adjusting element 3 be disposed in a right-hand region with respect to the center of the rear window glass sheet 12 in a left-to-right direction thereof. In other words, it is preferred that the directivity-adjusting element be disposed on a side opposite to the side of the feeding point 5 (the side of the H-oriented feeding point 5*a* and the L-oriented feeding point 5*b*) with respect to the center of the rear window glass sheet 12 in the left-to-right direction. The reason why this arrangement is adopted is to ensure that each of the two capacitively-coupled portion and the L-oriented transverse element 4 has a required length. The length of the L-oriented transverse element 4 contributes to improve mainly the antenna gain for frequency band L.

It is preferred in terms of having non-directivity when receiving a signal in frequency band H that the directivity-adjusting element 3 be located within a range of 0.13 λg or shorter from the center of the rear window glass sheet 12 in the left-to-right direction. The directivity-adjusting element is preferably located within a range of 0.04 λg to 0.1 λg from the center of the rear window glass sheet 12 in the left-to-right direction.

It is preferred that a portion of the directivity-adjusting element 3, which is extended in the vertical direction or the substantially vertical direction, have a conductor length of ($\lambda_g/29$) to 600 mm. When the extended portion has a conductor length of ($\lambda_g/29$) or longer, the antenna gain for frequency band H can be advantageously improved in comparison with a case where the extended portion has a conductor length of shorter than 600 mm. When the extended portion has a conductor length of 600 mm or longer, the antenna can be advantageously made more compact in comparison with a case where the extended portion has a conductor length of longer than 600 mm. The conductor length of the extended portion ranges preferably from ($\lambda_g/25.7$) to 500 mm, more preferably from ($\lambda_g/23.1$) to 400 mm.

For the same reason, it is preferred that when frequency band H uses at lease one frequency selected from the Japanese FM broadcast band, the US FM broadcast band and the lower band of the television VHF band, the extended portion of the directivity-adjusting element in the vertical direction or the substantially vertical direction have a conductor length of 80 to 600 mm. The conductor length of the extended portion ranges preferably from 90 to 500 mm, more preferably from 100 to 400 mm.

In each of the embodiments shown in FIGS. 1, 2, 4 and 5, the first capacitively-coupled portion, the second capacitively-coupled portion and the L-oriented transverse element 4 are disposed on a left side of the directivity-adjusting element 3 as seen from the car-interior-side or the car-exterior-side. In the first capacitively-coupled portion, both of the first L-oriented element 2*a* and the first H-oriented element 1*a* are configured to extend in the horizontal direction or the substantially horizontal direction, broadly in the transverse direction or the substantially transverse direction, the first L-oriented element 2*a* and the first H-oriented element 1*a* are parallel or substantially parallel to each other, and the first L-oriented element 2*a* is disposed above the first H-oriented element 1*a*.

In the second capacitively-coupled portion, both of the second L-oriented element 2*b* and the second H-oriented element 1*b* are configured to extend in the horizontal direction or the substantially horizontal direction, broadly in the transverse direction or the substantially transverse direction, the second L-oriented element 2*b* and the second H-oriented element 1*b* are parallel or substantially parallel to each other, and the second L-oriented element 2*b* is disposed above the second H-oriented element 1*b*.

When frequency band H uses at lease one frequency selected from the Japanese FM broadcast band, the US FM broadcast band and the lower band of the television VHF band, it is preferred in terms of obtaining an improved antenna gain for frequency band H that the first capacitively-coupled portion have a length of 230 to 430 mm, particularly 264 to 344 mm, and that the shortest distance between the first H-oriented element 1*a* and the first L-oriented element 2*a* in the first capacitively-coupled portion be from 5 to 15 mm, particularly from 8 to 12 mm. It is also preferred in terms of obtaining an improved antenna gain for frequency band H that the second capacitively-coupled portion have a length of 420 to 800 mm, particularly 488 to 732 mm, and that the shortest distance between the second H-oriented element 1*b* and the second L-oriented element 2*b* in the second capacitively-coupled portion be from 5 to 15 mm, particularly from 8 to 12 mm.

In each of the embodiment shown in FIGS. 1 and 2, the rear window glass sheet 12 has at least one bus bar 15*a* in a band shape and at least one bus bar 15*b* in a band shape disposed in a left-hand region and a right-hand region thereof, respectively. The bus bars 15*a* and 15*b* are configured to extend in the vertical direction or the substantially vertical direction of the rear window glass sheet 12. The bus bar 15*a* is connected to vehicle grounding, and the bus bar 15*b* is connected to the anode of a DC power supply 30. The rear window glass sheet has a plurality of heater strips extending in the horizontal direction or the substantially horizontal direction, broadly in the transverse direction or the substantially transverse direction, and the heater strips are short-circuited by short circuit lines 16 and 17 at portions thereof except for the bus bars 15*a* and 15*b*.

In the present invention, there is no limitation to the shape of the defogger. In other words, the number of the bus bars is not limited to 2. The number of the bus bars may be 2 or more than 2. The bus bars do not need to extend in the vertical direction or the substantially vertical direction of the rear window glass sheet 12. For example, the bus bars may extend in the transverse direction or the substantially transverse direction of the rear window glass sheet.

It is preferred for general motors in terms of ensuring sight that the shortest distance between the bus bars 15*a* and 15*b* be from 900 to 1,200 mm. In each of the embodiments shown in FIGS. 1 and 2, the two short circuit lines of a first short circuit line 16 and a second short circuit line 17 are disposed as the short circuit lines, and both of the short circuit lines are configured to extend in the vertical direction or the substantially vertical direction of the rear window glass sheet 12. The first short circuit line 16 is disposed on a left side of the center of the rear window glass sheet 12 in the left-to-right direction, and the second short circuit line 17 is disposed on a right side of the center of the rear window glass sheet 12 in the left-to-right direction. It is preferred in terms of obtaining an improved antenna gain for frequency band H that the first short circuit line 16 and the second short circuit line 17 be disposed within a range of 40 to 300 mm from the center of the rear window glass sheet in the left-to-right direction on both sides, respectively. It is preferred in terms of obtaining an improved antenna gain for frequency band L and obtaining an improved antenna gain for frequency band H that the shortest distance between the defogger and an L-oriented antenna conductor be from 20 to 40 mm.

FIG. 4 is a schematic view showing another embodiment of the second mode, which is different from the embodiment shown in FIG. 2. In the embodiment shown in FIG. 4, when an L-oriented transverse element 4 is called a first L-oriented transverse element 4, the first L-oriented transverse element 4 has a second L-oriented transverse element 20 (shown in a dotted line) and a third L-oriented transverse element 21 (shown in a dotted line) disposed therebelow in that order. The L-oriented antenna conductor in this mode comprises a vertical element 7 (shown in a dotted line) and the three L-oriented transverse elements 4, 20 and 21.

The vertical element 7 is disposed on a left-hand region with respect to the center of the rear window glass sheet in the left-to-right direction as seen from the car-interior-side or the car-exterior-side. The vertical element 7 is configured to extend in the vertical direction or the substantially vertical direction. The three L-oriented transverse elements 4, 20 and 21 are connected together by the vertical element 7. It should be noted that a connecting conductor 23, an enhancing element 22 for frequency band L, the H-oriented adjusting element 6, the H-oriented adjusting element base portion 6*a*, the H-oriented adjusting element return portion 6*b*, and the L-oriented transverse elements 20 and 21 are disposed as needed.

The first L-oriented transverse element 4 is connected to an L-oriented feeding point 5*b* through a connecting conductor 8. The L-oriented feeding point 5*b* includes a loop-forming element 18 (shown in a dotted line). The L-oriented feeding point 5*b*, the connecting conductor 8 and the loop-forming element 18 form a loop, which improves the antenna gain for frequency band H.

In order to improve the antenna gain for frequency band L, the rear window glass sheet has the directivity-adjusting element 3 disposed therein or thereon, the directivity-adjusting element being connected, through the connecting conductor 23 (shown in a dotted line), to the enhancing element 22 for frequency band L (shown in a dotted line), which is formed in a U-character shape or a substantially U-character shape.

In the embodiment shown in FIG. 4, the rear window glass sheet has a main portion of a first H-oriented antenna element 1*a*, a first L-oriented antenna element 2*a*, a second H-oriented antenna element 1*b*, a second L-oriented antenna element 2*b*, the L-oriented transverse element 4, the second L-oriented transverse element 20 and the third L-oriented transverse element 21 disposed therein or thereon so as to be parallel or substantially parallel to one another.

Each of the H-oriented antenna conductor, the L-oriented antenna conductor, the feeding point 5, the H-oriented feeding point 5*a*, the L-oriented feeding point 5*b* and the defogger is normally formed by printing paste containing conductive metal, such as silver paste, on a car-interior-side surface of the rear window glass sheet 12 and baking the printed paste. However, the present invention is not limited to this forming method. A linear member or foil member, which comprises a conductive substance, such as copper, may be formed on the car-interior-side surface or the car-exterior-side surface of the rear window glass sheet 12, or in the rear window glass sheet 12. A plastic film, which has a conductive layer formed therein or thereon, may be disposed on the car-interior-side surface or the car-exterior-side surface of the rear widow glass sheet 12 so that respective sections of the conductive layer serve as the H-oriented antenna conductor, the L-oriented antenna conductor and another element.

In the present invention, the rear window glass sheet 12 may have a light-shielding film formed thereon so that at least one of the L-oriented antenna conductor, the feeding point 5, the H-oriented feeding point 5*a* and the L-oriented feeding point 5*b* is disposed on the shielding film. The shielding film may comprise a ceramic film, such as a black ceramic film.

Next, the present invention will be described in reference to examples. It should be noted that the present invention is not limited to these examples, and that variations or modifications are included in the present invention as long as the variations and modifications do not depart from the spirit of the invention.

Now, the examples will be described in detail, referring to drawings.

EXAMPLE 1

Figure 5:
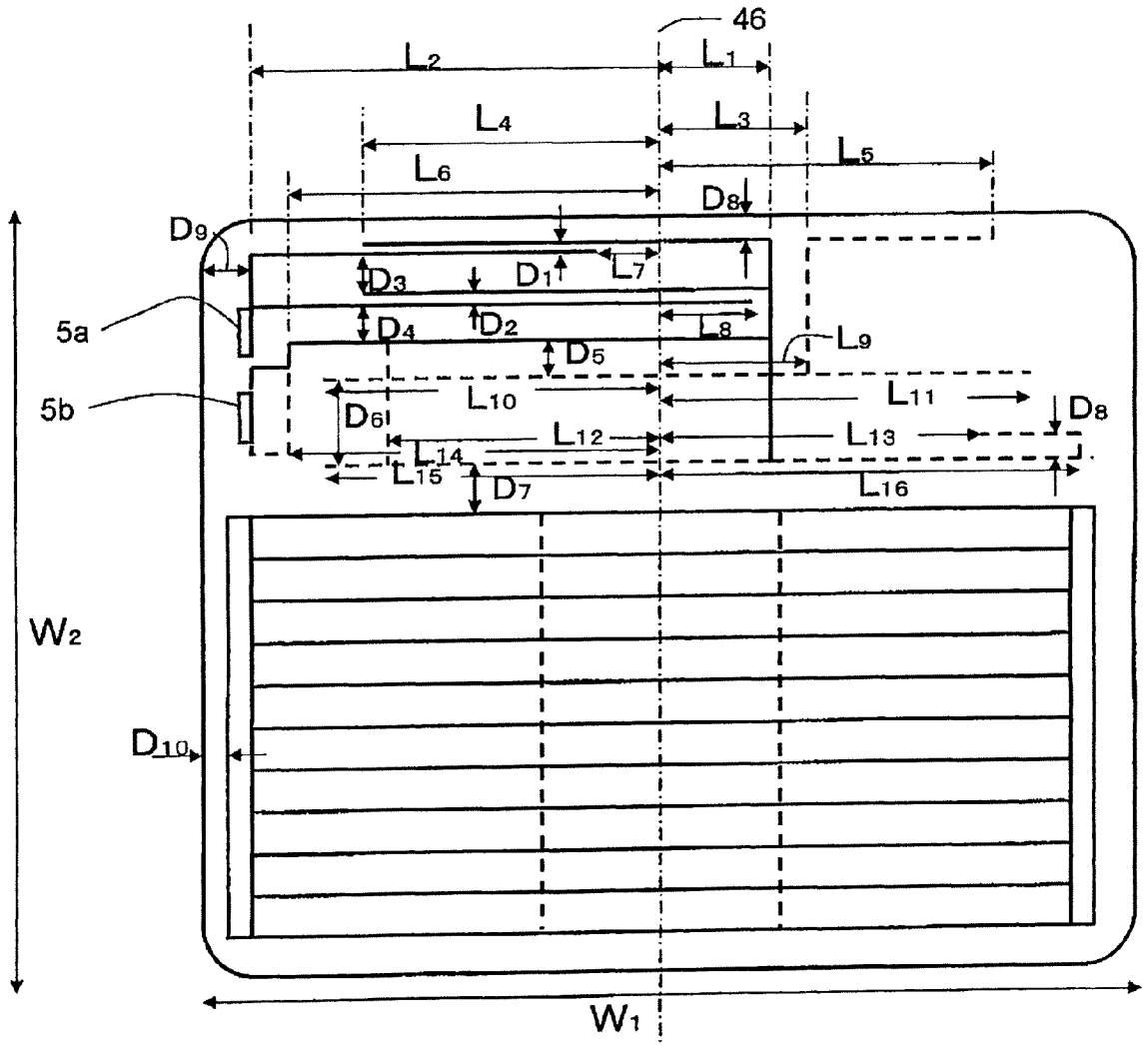
FIG. 5 is a schematic view showing dimensional relationships of the embodiment shown in FIG. 4.

A rear window glass for an automobile 12 was used to produce an automobile glass antenna as shown in FIGS. 4 and 5 (wherein FIG. 5 shows dimensional relationships of the embodiment shown in FIG. 4). The rear window glass sheet included a connecting conductor 23, an enhancing element 22 for frequency band L, an H-oriented adjusting element 6, an H-oriented adjusting element base portion 6*a,* an H-oriented adjusting element return portion 6*b,* a vertical element 7, L-oriented transverse elements 20 and 21, and a loop-forming element 18.

Figure 6:
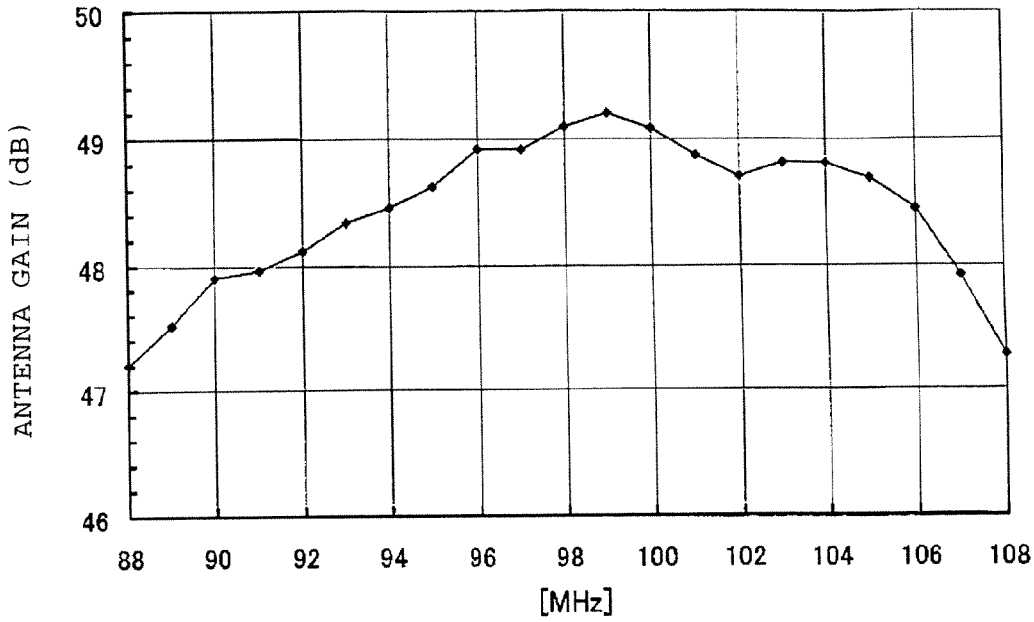
FIG. 6 is a characteristic graph of frequency-antenna gain in Example 1.

The dimensions and the constant of each element are listed below. In FIG. 5, reference numeral 46 designates the centerline of the rear window glass sheet 12 in the left-to-right direction. Although the number of the heater strips 14 shown in this figure is 11, the actual number was 17. Frequency-antenna gain characteristics of this example are shown in FIG. 6. Measurements were made on the antenna gains in the range of 0 to 360 degrees (every 5 degrees) in the horizontal direction as seen from the automobile. In FIG. 6, the average antenna gains in the range of 0 to 360 degrees were adopted, and the graph was depicted, setting the antenna gain of a reference dipole antenna at 60 dB as the reference. The measurement conditions for the graph shown in FIG. 6 are also applicable to the graph shown in FIG. 7. In Example 1, the antenna substantially served as a non-directional antenna.

| | |
|---|---|
| $L_1$ | 170 mm, |
| $L_2$ | 550 mm, |
| $L_3$ | 200 mm, |
| $L_4$ | 450 mm, |
| $L_5$ | 360 mm, |
| $L_6$ | 520 mm, |
| $L_7$ | 120 mm, |
| $L_8$ | 160 mm, |
| $L_9$ | 200 mm, |
| $L_{10}$ | 510 mm, |
| $L_{11}$ | 440 mm, |
| $L_{12}$ | 400 mm, |
| $L_{13}$ | 440 mm, |
| $L_{14}$ | 520 mm, |
| $L_{15}$ | 500 mm, |
| $L_{16}$ | 560 mm. |
| $D_1$ | 10 mm, |
| $D_2$ | 10 mm, |
| $D_3$ | 15 mm, |
| $D_4$ | 20 mm, |
| $D_5$ | 20 mm, |
| $D_6$ | 40 mm, |
| $D_7$ | 30 mm, |
| $D_8$ | 10 mm, |
| $D_9$ | 45 mm, |
| $D_{10}$ | 30 mm. |

| | |
|---|---|
| Shortest distance between H-oriented feeding point 5a and L-oriented feeding point 5b | 20 mm, |
| Transverse width $W_1$ of vehicle opening edge 13 for window | 1,320 mm, |
| Transverse width $W_2$ of vehicle opening edge 13 for window | 700 mm, |
| Distance between adjacent heater strips | 30 mm, |
| Conductor width of each of bus bars 15a and 15b | 15 mm, |
| Smaller one of angles formed by rear window glass sheet 12 and horizontal direction | 24.4 degrees. |

EXAMPLE 2 (COMPARATIVE EXAMPLE)

Figure 3:
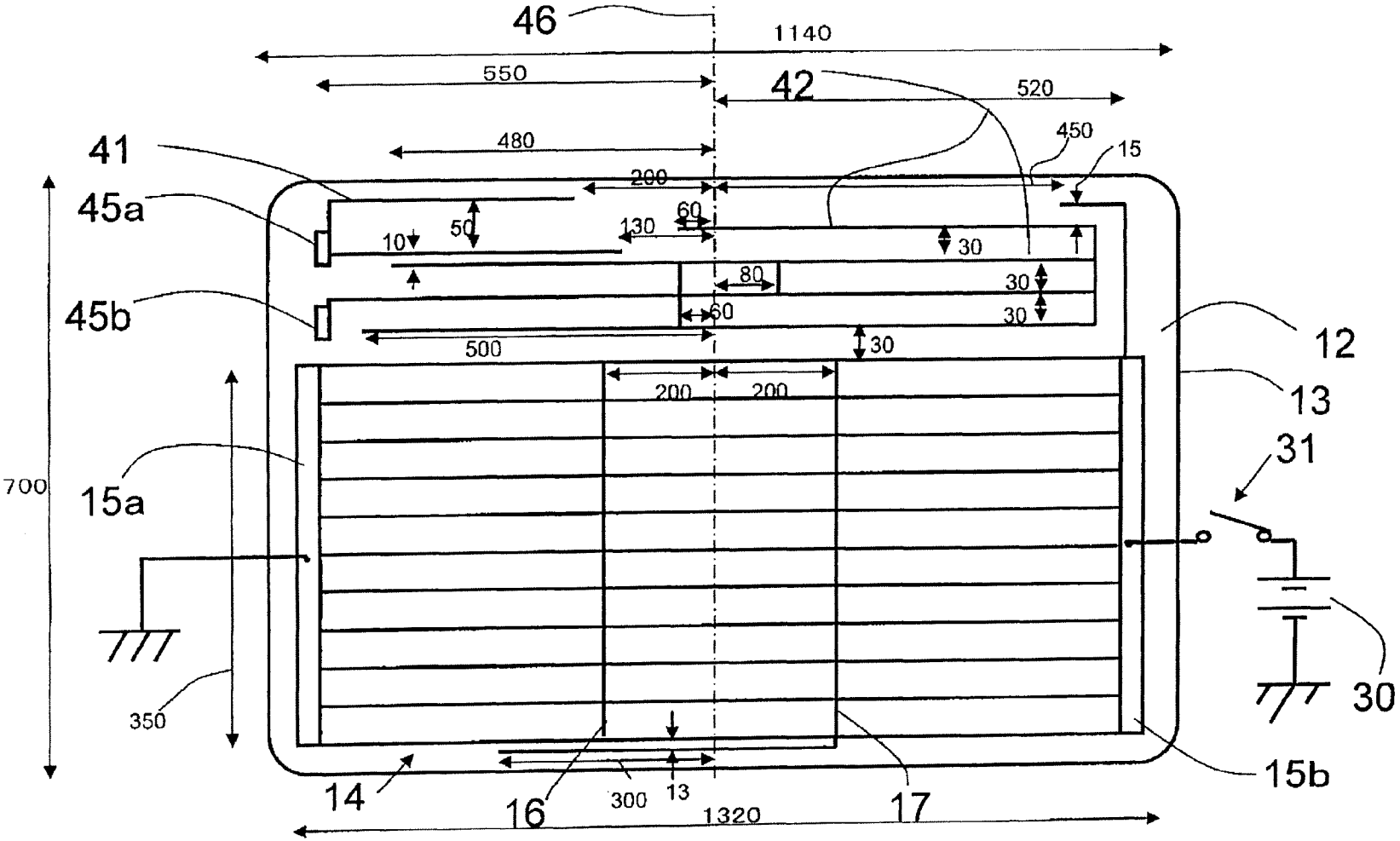
FIG. 3 is a schematic view showing a conventional antenna.
Figure 7:
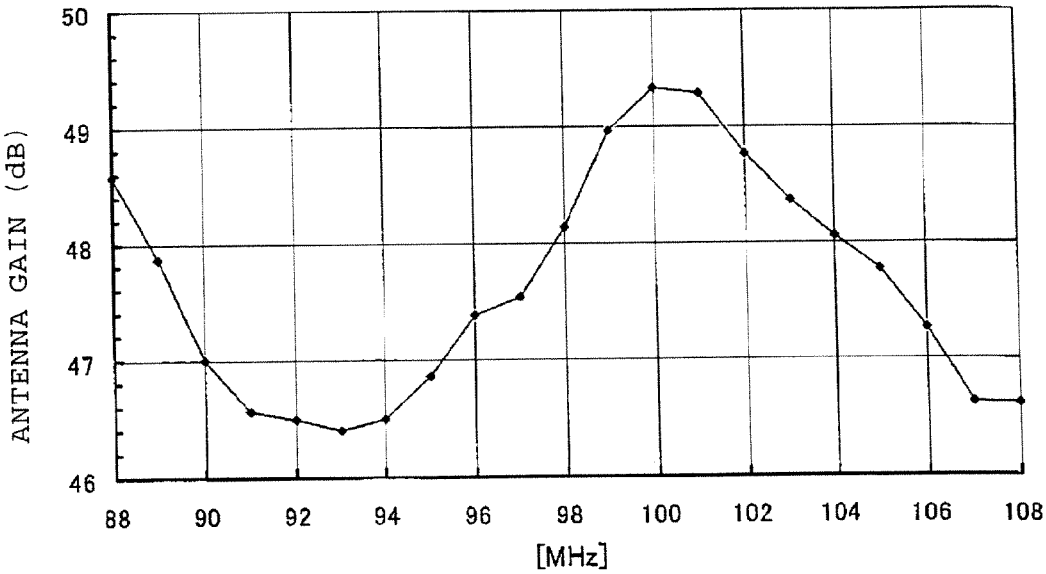
FIG. 7 is a characteristic graph of frequency-antenna gain in Example 2.

A glass antenna for an automobile was produced as shown in FIG. 3. In FIG. 3, the numerical value indicated in the vicinity of each of the arrows showing dimensions represents a dimension having a unit of mm. Frequency-antenna gain characteristics of this Comparative Example are shown in FIG. 7. In FIG. 7, the graph was depicted, setting the antenna gain of the reference dipole antenna at 60 dB as the reference.

EXAMPLE 3 (COMPARATIVE EXAMPLE)

A glass antenna for an automobile was produced in the same way as the glass antenna produced in Example 1 except that no second H-oriented element 1*b* was disposed. Measurements were made in the same way as Example 1. The average antenna gains for 88 to 108 MHz (the average at every 1 MHz) were reduced by 1.0 dB in comparison with Example 1. In Example 3, the glass antenna did not serve as a non-directional antenna.

EXAMPLE 4 (COMPARATIVE EXAMPLE)

No first H-oriented element 1*a* was disposed. $L_8$ was set at −120 mm (wherein the sign "−" means that the open end of a second H-oriented element 1*b* is disposed on a left side with respect to the centerline 46 of the left-to-right direction in FIG. 5) so that the open end of a second H-oriented element 1*b* was disposed in a left-hand region in FIGS. 4 and 5 (the second H-oriented element 1*b* was configured to have a shorter length than the one in Example 1). The glass antenna for an automobile in this Comparative Example was produced in the same way as the glass antenna in Example 1 except for these changes.

Measurements were made in the same way as the ones in Example 1. The average antenna gains for 88 to 108 MHz (the average at every 1 MHz) were reduced by 3.4 dB in comparison with Example 1. In Example 4, the antenna did not serve as a non-directional antenna.

The present invention is applicable to an AM broadcast band (MW band) of 520 to 1,700 kHz (520 kHz is directed to New Zealand), a long wave broadcast band (LW band) of 150 to 280 kHz, a short wave broadcast band (SW band) of 2.3 to 26.1 MHz, the Japanese FM broadcast band (76 to 90 MHz), the US FM broadcast band (88 to 108 MHz), a television VHF band (a lower band of 90 to 108 MHz and a higher band of 170 to 222 MHz), a television UHF band (470 to 770 MHz), a digital terrestrial television broadcast (473 to 767 MHz), a UHF television broadcast (473 to 767 MHz), the US digital television broadcast (698 to 806 MHz), the North America and the European television VHF band (45 to 86 MHz and 175 to 225 MHz, the 800 MHz band for automobile telephones (810 to 960 MHz), the UHF band (300 MHz to 3 GHz), the DSRC (Dedicated Short Range Communication in the 915 MHz band), the automobile keyless entry system (300 to 450 MHz), and the like.

The entire disclosure of Japanese Patent Application No. 2006-352019 filed on Dec. 27, 2006 including specification, claims, drawings and summary is incorporated herein by reference in its entirety.

What is claimed is:

1. A glass antenna for an automobile, comprising:

a plurality of antenna conductors disposed in or on a rear window glass sheet in a blank space which is adjacent to an electric heating defogger having a plurality of heater strips and a plurality of bus bars configured to feed a current to the heater strips, the plurality of antenna conductors comprising:

an H-oriented antenna conductor for a frequency band H higher than a frequency band L, the H-oriented antenna conductor including a first H-oriented antenna element and a second H-oriented antenna element, and an L-oriented antenna conductor for the frequency band L, the L-oriented antenna conductor including a first L-oriented antenna element, a second L-oriented antenna element, and a directivity-adjusting antenna element;

a feeding point disposed in or on the rear window glass sheet in the blank space, the feeding point being connected to the H-oriented antenna conductor and the L-oriented antenna conductor with both of the first H-oriented antenna element and the second H-oriented antenna element electrically connected to the feeding point and extending in a direction away from a side of the feeding point, and with the first L-oriented antenna element and the second L-oriented antenna element electrically connected to the directivity-adjusting antenna element and extending from a side of the directivity-adjusting antenna element toward the side of the feeding point;

a first capacitively-coupled portion formed by the first H-oriented antenna element and the first L-oriented antenna element being adjacent to each other and capacitively coupled to each other; and a second capacitively-coupled portion formed by the second H-oriented antenna element and the second L-oriented antenna element being adjacent to each other and capacitively coupled to each other.

2. The glass antenna according to claim 1, wherein each of the first H-oriented antenna element, the second H-oriented antenna element, the first L-oriented antenna element and the second L-oriented antenna element includes a leading portion;

the leading portion of the first H-oriented antenna element is disposed in the first capacitively-coupled portion;

the leading portion of the first L-oriented antenna element is disposed in the first capacitively-coupled portion;

the leading portion of the second H-oriented antenna element is disposed in the second capacitively-coupled portion; and the leading portion of the second L-oriented antenna element is disposed in the second capacitively-coupled portion.

3. The glass antenna according to claim 1, wherein:

the first capacitively-coupled portion is disposed at a position closer to a vehicle opening edge for the rear window glass sheet than the second capacitively-coupled portion; and when a portion of the vehicle opening edge closest to the first capacitively-coupled portion is called a closest vehicle edge portion, the first L-oriented antenna element is disposed at a position closer to the closest vehicle edge portion than the first H-oriented antenna element in the first capacitively-coupled portion.

4. The glass antenna according to claim 3, wherein the second L-oriented antenna element is disposed at a position closer to the vehicle edge portion than the second H-oriented antenna element in the second capacitively-coupled portion.

5. The glass antenna according to claim 1, wherein a main portion of the first H-oriented antenna element and a main portion of the first L-oriented antenna element are parallel or substantially parallel to each other; and a main portion of the second H-oriented antenna element and a main portion of the second L-oriented antenna element are parallel or substantially parallel to each other.

6. The glass antenna according to claim 1, wherein:

the frequency band H contains a frequency selected from the Japanese FM broadcast band, the US FM broadcast band and a lower band of a television VHF band, and the first H-oriented antenna element and the second L-oriented antenna element have an average distance of 10.5 to 19.5 mm therebetween.

7. The glass antenna according to claim 1, wherein:

the directivity-adjusting antenna element is connected to an H-oriented adjusting antenna element, which is disposed in or on the rear window glass sheet; and the H-oriented adjusting antenna element is disposed on a side opposite to the first capacitively-coupled portion with respect to the directivity-adjusting antenna element.

8. The glass antenna according to claim 7, wherein:

the H-oriented adjusting antenna element has an H-oriented adjusting antenna element base portion extended in a transverse direction or a substantially transverse direction, starting at the directivity-adjusting antenna element; and the H-oriented adjusting antenna element base portion is coupled to an H-oriented adjusting antenna element return portion turned back and further extended along the first portion toward a direction where the H-oriented adjusting antenna element starts at the directivity-adjusting antenna element.

9. The glass antenna according to claim 8, wherein, the H-oriented adjusting antenna element base portion and the H-oriented adjusting element return portion are parallel or substantially parallel to each other and have a distance of 5 to 15 mm therebetween.

10. The glass antenna according to claim 1, wherein:

the frequency band L comprises at least one of an AM broadcast band and a long wave broadcast band, and the frequency band H contains at least one frequency selected from the Japanese FM broadcast band, the US FM broadcast band and a lower band of a television VHF band.

11. A rear window glass sheet for an automobile including at least the H-oriented antenna conductor and the L-oriented antenna conductor defined in claim 1.

12. The glass antenna device according to claim 1, wherein:

the L-oriented antenna conductor includes an L-oriented transverse antenna element which is electrically connected to the feeding point, extends in a transverse direction or a substantially transverse direction from the side of the feeding point, and is connected to the directivity-adjusting antenna element, and the second capacitively-coupled portion is partly or entirely disposed between the first capacitively-coupled portion and the L-oriented transverse antenna element.

13. A glass antenna for an automobile, comprising:

a plurality of antenna conductors disposed in or on a rear window glass sheet in a blank space which is adjacent to an electric heating defogger having a plurality of heater strips and a plurality of bus bars configured to feed a current to the heater strips, the plurality of antenna conductors comprising:

an H-oriented antenna conductor for a frequency band H higher than a frequency band L, the H-oriented antenna conductor including a first H-oriented antenna element and a second H-oriented antenna element, and an L-oriented antenna conductor for the frequency band L, the L-oriented antenna conductor including a first L-oriented antenna element, a second L-oriented antenna element, and a directivity-adjusting antenna element;

an H-oriented feeding point and an L-oriented feeding point disposed in or on the rear window glass sheet in the blank space with the H-oriented feeding point being connected to the H-oriented antenna conductor and the L-oriented feeding point being connected to the L-oriented antenna conductor, the H-oriented feeding point and the L-oriented feeding point having a shortest distance of 0.1 to 200 mm therebetween, wherein:

both of the first H-oriented antenna element and the second H-oriented antenna element are electrically connected to the H-oriented feeding point and extend in a direction away from a side of the H-oriented feeding point, and the first L-oriented antenna element and the second L-oriented antenna element are connected to the directivity-adjusting antenna element, and both of the first L-oriented antenna element and the second L-oriented antenna element extend from a side of the directivity-adjusting antenna element toward a side of the L-oriented feeding point, a first capacitively-coupled portion formed by the first H-oriented antenna element and the first L-oriented antenna element being adjacent to each other and capacitively coupled to each other; and a second capacitively-coupled portion formed by the second H-oriented antenna element and the second L-oriented antenna element being adjacent to each other and capacitively coupled to each other.

14. The glass antenna according to claim 13, wherein each of the first H-oriented antenna element, the second H-oriented antenna element, the first L-oriented antenna element and the second L-oriented antenna element includes a leading portion;

the leading portion of the first H-oriented antenna element is disposed in the first capacitively-coupled portion;

the leading portion of the first L-oriented antenna element is disposed in the first capacitively-coupled portion;

the leading portion of the second H-oriented antenna element is disposed in the second capacitively-coupled portion; and the leading portion of the second L-oriented antenna element is disposed in the second capacitively-coupled portion.

15. The glass antenna according to claim 13, wherein:

the first capacitively-coupled portion is disposed at a position closer to a vehicle opening edge for the rear window glass sheet than the second capacitively-coupled portion; and when a portion of the vehicle opening edge closest to the first capacitively-coupled portion is called a closest vehicle edge portion, the first L-oriented antenna element is disposed at a position closer to the closest vehicle edge portion than the first H-oriented antenna element in the first capacitively-coupled portion.

16. The glass antenna according to claim 15, wherein the second L-oriented antenna element is disposed at a position closer to the vehicle edge portion than the second H-oriented antenna element in the second capacitively-coupled portion.

17. The glass antenna according to claim 13, wherein a main portion of the first H-oriented antenna element and a main portion of the first L-oriented antenna element are parallel or substantially parallel to each other; and a main portion of the second H-oriented antenna element and a main portion of the second L-oriented antenna element are parallel or substantially parallel to each other.

18. The glass antenna according to claim 13, wherein:

the frequency band H contains a frequency selected from the Japanese FM broadcast band, the US FM broadcast band and a lower band of a television VHF band, and the first H-oriented antenna element and the second L-oriented antenna element have an average distance of 10.5 to 19.5 mm therebetween.

19. The glass antenna according to claim 13, wherein:

the directivity-adjusting antenna element is connected to an H-oriented adjusting antenna element, which is disposed in or on the rear window glass sheet; and the H-oriented adjusting antenna element is disposed on a side opposite to the first capacitively-coupled portion with respect to the directivity-adjusting antenna element.

20. The glass antenna according to claim 19, wherein: the H-oriented adjusting antenna element has an H-oriented adjusting antenna element base portion extended in a transverse direction or a substantially transverse direction, starting at the directivity-adjusting antenna element; and the H-oriented adjusting antenna element portion is coupled to an H-oriented adjusting antenna element return portion turned back and further extended along the first portion toward a direction where the H-oriented adjusting antenna element starts at the directivity-adjusting antenna element.

21. The glass antenna according to claim 20, wherein, the H-oriented adjusting antenna element base portion and the H-oriented adjusting element return portion are parallel or substantially parallel to each other and have a distance of 5 to 15 mm therebetween.

22. The glass antenna according to claim 13, wherein:

the frequency band L comprises at least one of an AM broadcast band and a long wave broadcast band, and the frequency band H contains at least one frequency selected from the Japanese FM broadcast band, the US FM broadcast band and a lower band of a television VHF band.

23. A rear window glass sheet for an automobile including at least the H-oriented antenna conductor and the L-oriented antenna conductor defined in claim 13.

24. The glass antenna device according to claim 13, wherein:

the L-oriented antenna conductor includes an L-oriented transverse antenna element which is electrically connected to the L-oriented feeding point, extends in a transverse direction or a substantially transverse direction from the side of the L-oriented feeding point, and is connected to the directivity-adjusting antenna element, and the second capacitively-coupled portion is partly or entirely disposed between the first capacitively-coupled portion and the L-oriented transverse antenna element.

* * * * *